US006549637B1

(12) United States Patent
Risch

(10) Patent No.: US 6,549,637 B1
(45) Date of Patent: Apr. 15, 2003

(54) LOUDSPEAKER WITH DIFFERENTIAL FLOW VENT MEANS

(75) Inventor: Jon M. Risch, Toomsuba, MS (US)

(73) Assignee: Peavey Electronics Corp., Meridian, MS (US)

( * ) Notice: Subject to any disclaimer, the term of this patent is extended or adjusted under 35 U.S.C. 154(b) by 0 days.

(21) Appl. No.: 09/159,599

(22) Filed: Sep. 24, 1998

(51) Int. Cl.[7] ..... H04R 25/00

(52) U.S. Cl. ..... 381/397; 381/412; 381/419; 381/420; 181/160; 181/166; 181/185; 181/196

(58) Field of Search ..... 381/397, 412, 381/413, 411, 419, 420, 386, 410, 159, 154; 181/151, 166, 160, 179, 182, 184, 196

(56) References Cited

U.S. PATENT DOCUMENTS

| | | | | |
|---|---|---|---|---|
| 1,915,358 | A | * | 6/1933 | Giles |
| 3,778,551 | A | | 12/1973 | Grodinsky |
| 3,991,286 | A | | 11/1976 | Henricksen |
| 4,138,593 | A | | 2/1979 | Hasselbach et al. |
| 4,196,792 | A | | 4/1980 | Grieves et al. |
| 4,210,778 | A | * | 7/1980 | Sakuraui |
| 4,284,166 | A | * | 8/1981 | Gale |
| 4,387,275 | A | | 6/1983 | Shimada et al. |
| 4,625,328 | A | | 11/1986 | Freadman |
| 4,757,547 | A | * | 7/1988 | Daney |
| 4,811,403 | A | | 3/1989 | Henricksen et al. |
| 4,928,788 | A | | 5/1990 | Erickson |
| 5,042,072 | A | | 8/1991 | Button |
| 5,246,353 | A | | 9/1993 | Sohn |
| 5,357,586 | A | | 10/1994 | Nordschow et al. |
| 5,497,428 | A | | 3/1996 | Rojas |
| 5,533,132 | A | | 7/1996 | Button |
| 5,537,481 | A | | 7/1996 | Voishvillo et al. |
| 5,909,015 | A | * | 6/1999 | Yamomoto |
| 6,243,479 | B1 | * | 6/2001 | Proni |

FOREIGN PATENT DOCUMENTS

| | | |
|---|---|---|
| FR | 2 667 212 | 3/1992 |
| JP | 3 239099 | 10/1991 |
| JP | 6 141396 | 5/1994 |

* cited by examiner

*Primary Examiner*—Rexford Barnie
*Assistant Examiner*—Dionne Harvey
(74) *Attorney, Agent, or Firm*—Dykema Gossett, PLLC

(57) ABSTRACT

Differential flow vents allow airflow within a vent to be preferential. A flange disposed within a vent introduces non-linearities and causes a preferred direction of airflow into an expanding volume. The differential flow vents are used in conjunction with the natural motion of the loudspeaker cone acting as a pump to cool the loudspeaker cabinet enclosure without having to directly cool the woofer magnet structure. In one embodiment, at least one pair of opposed differential flow vents within the cabinet enclosure provide fresh air to be preferentially circulated to cool the interior of a loudspeaker system. In another embodiment, by providing an odd number of opposed differential flow vents within the cabinet enclosure, positive air circulation also results. By making either the pairs or odd number of differential flow vents to be asymmetrical, dynamic woofer offset is compensated. By placing the differential flow vents in the backplate of the woofer magnet structure and using the natural motion of the woofer speaker cone acting as a pump, cabinet enclosed air may be preferentially pumped into the magnet structure for cooling heated components. By providing the differential flow vents in both the cabinet enclosure and in the backplate of the woofer magnet structure, maximal cooling is achieved. Where system linearity is not an issue, pairs of opposed symmetrical differential flow vents may be used in the cabinet enclosure and or woofer magnet structure for cooling.

40 Claims, 8 Drawing Sheets

LOUDSPEAKER WITH DIFFERENTIAL FLOW VENT MEANS

BACKGROUND OF THE INVENTION

The present invention is directed to a loudspeaker system, and in particular to using differential flow vents within a loudspeaker enclosure and within the backplate of a loudspeaker magnet structure to provide preferential airflow to cool and ventilate the system and to compensate for non-linear effects created by dynamic loudspeaker offset such as that found in a woofer.

Reference is made to FIG. 1 which illustrates a conventional loudspeaker 10 using a cone-shaped diaphragm 12 and a voice coil 14 formed by having wire wound around an annular coil form 16 made from a heat resistant material which may be metallic or plastic-based. The diaphragm 12, otherwise known as a speaker cone, vibrates through an electro-mechanical drive. The wire used in forming the voice coil has a coating for insulation purposes. The material of such coating may include shellac, an epoxy material, or varnish, wherein the coil windings are cemented onto the coil form. The voice coil defines a voice coil chamber 18 therein. The coil form is attached to a spider element 20. The spider element is fabricated from a resin impregnated cloth-like material and has circular corrugations formed therein. The spider element resiliently supports the coil form from a loudspeaker frame, also known as a basket 22 which typically comprises a metal material. In certain situations, the spider may be integrally formed with the coil form. The basket may be attached to the speaker enclosure by, a gasket 24. The cone 12 may be fabricated from well-known materials and is attached to the coil form 16 at one end, while attached to a speaker surround 26 at the other, possibly with the use of gasket 24. The surround is attached to the basket. The voice coil operates in a conventional manner in an annular gap 28, which is positioned between a center pole piece 30 and an annular magnet 32. The pole piece and magnet causes the mechanical actuation of the voice coil and the coil form about the voice coil chamber in response to electrical signals received at the coil. This in turn causes the speaker cone diaphragm to vibrate with acoustical energy. A backplate 34 and top plate 36 help secure the above mentioned components in place and direct the magnetic field from the magnet. A protective dust cap 38 is placed over the voice coil chamber.

When the electrical signal or current is supplied to the voice coil, the speaker cone vibrates in accordance with the audio frequency and polarity of the electrical signal. The winding used to form the coil has an electrical resistance to the flow of current and generates heat. This heat increases the temperature within the loudspeaker and the corresponding enclosure. As heat is generated in the voice coil, it is conducted away from the coil by means of both the thermally conductive voice coil form and the front plate. These function to dissipate the heat energy. Thus, a portion of electrical power input towards driving the speaker is converted into heat as opposed to acoustic energy. For high power loudspeaker systems, the temperature of the voice coil and the loudspeaker enclosure correspondingly increases. Accordingly, the components used in the loudspeaker control the ability of the loudspeaker to tolerate heat. When the capacity of heat dissipation of the loudspeaker components is exceeded, overheating occurs.

To prevent overheating and to provide loudspeaker cooling, methods to remove heat energy have been suggested since the operation and performance of the loudspeaker is directly affected by the heat tolerance level. For example, it is well known to cool a loudspeaker by using a heat sink. U.S. Pat. No. 4,138,593 to Hasselbach et al. discloses an extended heatsink in contact with the loudspeaker magnet structure for dissipating heat across the enclosure housing. However, the hot air remains in the interior of the enclosure. U.S. Pat. No. 4,210,778 to Sakurai et al. discloses a heat pipe device for transferring heat over a distance to be vented out of the cabinet. The heat pipe is attached to the magnet structure and draws heat from the magnet structure, and the terminus of the heat pipe is centered within the vent of the enclosure. Yet, this appears to be unsatisfactory because any airflow pertaining to the action of the vent is not a continuous motion, but encompasses air in the vent which is merely oscillating back and forth with no net travel. What is needed is a manner of exhausting the heated air out of the enclosure.

The prior art attempts to exhaust this heated air through the use of vents positioned within the loudspeaker enclosure. U.S. Pat. No. 4,196,792 to Grieves et al. discloses a V-slot or V-shaped vent installed in the back wall of the enclosure of a speaker assembly and suggests that the vent prevents pressure build-up and whistling. U.S. Pat. No. 4,284,166 to Gale discloses a port opening in a speaker enclosure for free movement of air outwardly and inwardly. U.S. Pat. No. 3,778,551 to Grodinsky discloses holes in the speaker cabinet which open to the outside and lead via an air passage to the power transistors. Using the speaker cone as an air pump, air is forced into and out of the cabinet for cooling the transistors. Japanese Patent Application No. 6-141396 discloses a series of passages through the front plate of a speaker to allow air circulation. U.S. Pat. No. 5,533,132 to Button discloses air movement within the loudspeaker to aid in heat dissipation, and in particular, the embodiment comprises a symmetrical pair of air vents in the enclosure in which the air moves in and out at high velocity so as to act as a fan on a vaned heat sink. But with all of these techniques, the problem with providing simple holes or vents in a speaker enclosure is that air only moves back and forth in the vent, even with the use of the speaker cone as an air pump. Moreover, small openings or holes do not act preferentially by themselves and tend to be acoustically resistive, constituting an acoustical leak which lowers the quality factor or efficiency of the enclosure.

The difficulty with using these vents of the prior art may be better recognized through an understanding of the hole or vent being idealized. In an idealized or theoretically perfect vent, the same slug of air moves back and forth within the vent. The more this slug of air is disturbed or broken up, the less efficient the vent acts as an acoustical element. If the slug of air is never changed, it would heat up and reach thermal equilibrium with the surroundings. Due to turbulence and any net air motion outside of the enclosure, a portion of the slug of air will be very slowly exchanged over a period of time for different "fresh" air. As a result, the slug of air will continue to heat up and reach thermal equilibrium with the surroundings. The net effect is only a small amount of cooling.

Likewise, in another attempt to provide loudspeaker cooling, U.S. Pat. No. 4,928,788 to Erickson discloses a ported reflex speaker enclosure and a method which is somewhat similar to convection cooling techniques that capitalizes on the natural tendency of heated air to rise. Although it is suggested that heated air is exhausted from the enclosure via the port, under principles of convection cooling, hot air tends to rise and thus, any air flowing from the hole residing on the bottom of the speaker housing would consequently not aid in the cooling of the speaker. Additionally, notches or openings near mounting holes in the speaker system are discussed to complement cooling; however, they appear to function as resistive vents, or some sort of pressure relief and with the presence of a larger bass reflex vent, these openings will be effectively short-circuited acoustically and see little or no pressure. Accordingly, what is needed is an improvement over the conventional vent of the prior art, and in particular, a vent that provides airflow in a preferred direction. It is desirable to overcome the drawback of the conventional vent having a slug of air moving back and forth by providing the improved vent which will allow preferential airflow. Preferential airflow means that the air flows more easily in one direction (a preferential direction) than in the opposite direction. Therefore, more air will flow in said one direction than in said opposite direction as long as the operating conditions of the loudspeaker device remains the same.

Additionally, what is also needed is a manner of placing the improved vent within the speaker enclosure to ensure preferential airflow of fresh air into the enclosure and preferential airflow of heated air exhausted out of the enclosure all to accomplish significant cooling of the enclosure, and not merely the minor incidental cooling effects of the prior art. It would be ideal to use the natural motion of the speaker cone as a pump along with such an improved vent to positively circulate air throughout the loudspeaker system to cool heated components.

Other methods of cooling a loudspeaker includes a liquid cooling method, wherein Japanese Patent Application No. 3-23909 to Saito discloses inlet and outlet tubes through which an external source of cooling medium like liquid air is supplied to cool a loudspeaker assembly. However, the method has drawbacks because an external source must be turned to, thus making the fabrication and manufacturing process more complex and costly. Furthermore, other methods involve mechanically forcing air through vents. For example, U.S. Pat. No. 3,991,286 to Henrickson discloses a blower used for circulating air to the heat sink. Yet, such air circulation must be powered by an external device, making this apparatus expensive to manufacture. U.S. Pat. No. 4,811,403 to Hendericksen et al. also utilizes an externally powered fan to force air to cool the loudspeaker through two openings or aperatures, but, this air flow is controlled by the fan. Also, the incorporation of an airflow channel acts as an acoustical leak and significantly reduces the efficiency of the vented enclosure. U.S. Pat. No. 4,757,547 to Danley discloses a blower or fan used to cool the magnet structure through air passages denoted as inlets and outlets, yet, the fan is powered by a signal robbed directly from the speaker and forces movement of air throughout the loudspeaker. This is disadvantageous because using the same signal that is sent to the speaker to also power the fan creates distortion due to the loading of the full wave bridge rectifier. Moreover, this lowers efficiency because tapping from this signal also steals power that would otherwise be used to make the loudspeaker play louder. It is thus desirable to provide loudspeaker cooling using the above-mentioned improved vents placed in speaker enclosure in a manner that provides positive airflow circulation, and yet in a manner which eliminates reliance upon an external device requiring power. It would be cost-effective if these improved vents are used with the natural motion of the speaker cone acting as a pump.

While cooling the loudspeaker is of primary concern with such an improved vent, it is also desirable to provide an improved vent that helps but never hinders the acoustics of the loudspeaker system. Referring for illustrative purposes to a particular type of loudspeaker such as a woofer providing lower acoustical sound frequencies, in a vented bass reflex cabinet, the woofer cone motion alternately pressurizes and depressurizes the interior of the cabinet enclosure, forcing air in the vents or ports to move back and forth. At the resonant frequency of the vented cabinet system, the woofer cone motion is all but nil, while the air velocity in the vents is high. The cabinet air volume comprises an acoustical analog to a capacitor. The mass of air in the vent or port comprises an acoustical analog to an inductor. In order for the vented bass reflex resonant system to maximize bass output in a desired manner, the nature of these resonant elements should be as perfect and as pure as possible. That is, the air inside the cabinet should not be subject to any leaks, other than the vents themselves, and the walls of the cabinet should be perfectly stiff. This allows maximization of the purity of the capacitance represented by the enclosed air volume. In the same way, the mass of air moving back and forth in the vent should maintain its integrity as much as possible. A perfect vent would always have the same air moving back and forth within it. Often times however, the woofer has an inherent dynamic offset and tends to move either forward or backward, thereby posing an additional parameter for causing distortion and system non-linearity.

The Thiel/Small theory of vented cabinet design calls for a vent cross-sectional area equal to the area of the woofer cone radiating area. Practical real world-constraints typically do not allow for a vent this large, for the larger the area, the longer a vent has to be for a given tuning frequency. The practical rule of thumb to prevent significant reduction in vent efficiency, requires making the vent area approximately ¼ the woofer cone radiating area. As the area of the vent decreases, the velocity in the vent increases as do the losses. At some point, the vent will begin to make spurious noise and whistle. Inefficiencies arise when the air in the vent becomes disturbed, due to turbulence from excessive velocity. This occurs in a vent that is too small. Other factors that causes the air in the vent to become disturbed include rough edges, the cabinet having less than perfectly rigid walls and air leaks. As such, it would be desirable to provide the improved vent mentioned above in a manner that retains vent efficiency. It would be ideal if the improved vent were able to compensate or correct non-linearities, such as the distortion caused by a woofer offset or by less than perfect loudspeakers with less than optimally sized vents. What is ultimately needed is a manner of providing such an improved vent that accounts for the aspect of balancing the vent actions to provide symmetry and linearity so as to improve acoustics. Thus far, the prior art fails to mention the use of a differential flow vent for correcting system non-linearities.

Besides placing vents within the loudspeaker enclosure and forcing air into the enclosure to cool the loudspeaker system, the prior art also suggests directly cooling the electro-mechanical driving components supported within the enclosure. U.S. Pat. No. 4,625,328 to Freadman discloses a heat sink attached to the magnetic structure's front plate, and the motion of the cone is supposedly causing air waves to increase circulation in the area of the heat sink. The motion of the air, however, flows back and forth and any air exchange to provide long term cooling is incidental. It should also be noted that the air immediately behind the speaker cone is usually within an enclosure, and thus there is little opportunity for large scale air exchange, even with incidental local turbulence. French Patent Application No. 2,667,212 to Maurice discloses fins just below the spider for moving air back and forth; however, a similar problem exists in that the air is merely moved as opposed to being pumped in a preferential direction.

U.S. Pat. No. 5,042,072 to Button discloses cooling the voice coil directly by forcing air displaced by movement of a dome-shaped diaphragm through channels next to the voice coil to and through vents located in the magnet structure of the voice coil. However in practice, this system has drawbacks because air is merely moved back and forth, oscillating in place, and there is no net air movement provided. When such a speaker is placed in a typical enclosure, the air trapped inside will not allow even the incidental turbulence to provide very much long term cooling for the loudspeaker's magnet structure. Furthermore, these vents require modifications from a typical structure to the front plate and the pole piece. This reduces the amount of magnetic flux due to the removal of significant portions of the front plate in proximity to the voice coil.

U.S. Pat. No. 5,246,353 to Sohn discloses gaskets used on the voice coil assembly and a bellows assembly to pump air. Inlet and outlet vents, however, are located on the vibrating medium and it is suggested that air breezing is used to provide an air pressure bias and to maintain pressure on a thin and normal flexible speaker diaphragm. However, the intake of air will always be in equilibrium with hot air being exhausted from the enclosure. As such, air is not positively circulated about the enclosed volume. Similarly, U.S. Pat. No. 5,497,428 to Rojas discloses air vents and two air channels used in cooling the voice coil, however, the same stale air oscillates whereby it moves back and forth, yet does not flow in a definite or preferred direction.

U.S. Pat. No. 5,357,586 to Nordschow et al. discloses multiple air flow paths used to cool the speaker, as well as cabinet vents. However, the paths in the magnet structure are too complicated to manufacture cost-effectively. Moreover, issues of system linearity and acoustical balancing of vents are not addressed. While it is suggested that vent efficiency is improved with cabinet cooling, placing added member 40 in the vent tube reduces the vent area severely to perhaps ⅕ of its original area. This is contrary to known acoustic principles, where vent efficiency is measured by how close the vent action approximates the theoretical ideal. Vent area relates directly to vent efficiency; and thus, by placing added member 40 in the vent tube, vent tuning would change appreciably and either necessitate a greater number of vents or that the vent be scaled up.

As there have been air-cooled speaker cabinets with external fans, there too have been air-cooled speaker magnet structures facilitated by an external power source, whether that source is a 120 VAC or compressed air. Other approaches place a full wave bridge rectifier through a resistor across the speaker inputs, and convert some of the AC input signal into filtered DC to run a fan. Yet, these approaches generate distortion due to the loading of the bridge rectifier and the filter caps, in addition to robbing power to the woofer.

Consequently, it is desirable to directly cool a loudspeaker, such as a woofer magnet structure, using an improved vent that provides preferential airflow in a single direction and that ensures a net air exchange that is increased substantially beyond the incidental and minimal exchange seen in the prior art. Like the need for cooling the speaker enclosure, what is needed is an improved vent that would directly cool the heated electro-mechanical components with positive air circulation well beyond the merely moving air back and forth as in the prior art. It would be advantageous if the improved vent were able to compensate or correct less than perfect loudspeakers and eliminated non-linearities.

SUMMARY OF THE INVENTION

The present invention provides differential flow vents for controlling airflow to be in a preferred direction, not merely back and forth as in the conventional vents of the prior art. A loudspeaker device with differential flow vent means has an enclosure being substantially closed to define an interior space. A loudspeaker assembly is supported within this space, and the differential flow vent means provides communication between the space and ambient air. The flow vent means define a first cross-sectional area and a second cross-sectional area smaller than the first cross-sectional area and produce a greater resistance to airflow in one direction from the second cross-sectional area to the first cross-sectional area than in the opposite direction. By deliberately constructing differential flow vents to be non-linear, the airflow through the vent is preferential.

The differential flow vent means may be constructed to be a tapered portion having a first end and an opposite second end. The first end defines the first cross-sectional area and the second end defines the second cross-sectional area. The differential flow vent means is disposed within the enclosure and has an overall length, while the tapered portion has a length which is substantially less than the overall length. In one embodiment, the tapered portion is of generally frusto-conical configuration and may be joined with a cylindrical portion. In another embodiment, the differential flow vent means includes a first pair of generally parallel spaced walls and a second pair of generally parallel spaced walls extending substantially perpendicular to the first pair of walls. In this embodiment, the differential flow vent means comprises a plurality of flanges defining a first end and a second opposite end, wherein the flanges comprises a first pair of flanges tapering toward one another from the first pair of walls and a second pair of flanges spaced from the first pair of flanges and tapering toward one another from the second pair of walls. In other embodiments, the first pair of flanges may be used and alternatively even one flange by itself.

By placing differential flow vents within a loudspeaker cabinet enclosure and by using the natural motion of the speaker cone, fresh air may be preferentially pumped into the enclosure and heated air may be preferentially pumped out of the enclosure. With this implementation, positive air circulation is provided to cool the cabinet enclosure without directly having to cool the loudspeaker magnet structure.

In order to directly cool the loudspeaker magnet structure, such as a woofer assembly, differential flow vents are placed within the backplate of the woofer assembly so that cabinet air is preferentially pumped into and out of the woofer assembly using the natural motion of the cone. According to this implementation, positive air circulation is provided to thereby directly cool the voice coil and electro-mechanical components that have become heated.

By placing differential flow vents in both the loudspeaker enclosure and backplate of the woofer assembly, maximal cooling of the loudspeaker system is achieved.

But besides cooling the loudspeaker system, it is an object of this invention to use differential flow vents in a manner that compensates for non-linearities created by the loudspeaker offset. In one embodiment, a single differential flow vent is placed within the cabinet enclosure to compensate or correct the inherent forward or backward movement of a woofer. In a preferred embodiment, a pair of opposed mildly asymmetrical differential flow vents are placed in the cabinet enclosure to pressurize or depressurize the cabinet enclosure with the natural motion of the speaker cone acting as a pump. One differential flow vent acts as an intake vent and the other as an out-take vent. Effectively, one vent provides greater resistance to airflow from ambient air into the cabinet space, while the other vent provides greater resistance to airflow from the space to ambient air. Between the pair of vents, the resistance to airflow of one vent is greater than that of the other. This respectively cancels the forward or backward inherent movement of the woofer and provides air circulation in a definite direction which cools the enclosed cabinet supporting electronics for a powered speaker system, or for the woofer along with an associated magnet structure when handling a large amount of input power. Moreover, whereas the conventional vents used in the prior art created additional distortion for lack of opposing or balancing elements, these distortions are minimized with the current differential flow vents.

In yet another embodiment, the same result of cooling the loudspeaker while compensating for non-linearities is accomplished. Instead of a single pair of opposed asymmetrical differential flow vents, multiple pairs are used to pressurize or depressurize the cabinet depending upon the severity of the inherent forward or backward movement of the woofer assembly. Alternately in still another embodiment, an odd number of opposed asymmetrical differential flow vents are used in the cabinet enclosure to cool the cabinet and to compensate for non-linearities. The number of vents is varied based upon the degree of compensation required to correct the woofer offset. Of course, where it is desired to not affect the symmetry of the woofer, opposed symmetrical vents are used.

When cooling the loudspeaker magnet structure directly, pairs of opposed symmetrical vents are placed in the woofer backplate when it is desired to not affect the symmetry of the woofer. But, when the inherent offset of the woofer must be compensated for, asymmetrical pairs are used. In a preferred embodiment, differential flow vents in the magnet structure are used with a foam resistance plug in place of a center pole piece for compensating for non-linearities.

With the current invention, the loudspeaker cabinet and magnet structure are cooled without dependency upon any external sources of energy or power other than the normal signal applied to the loudspeaker to move it and to make sound. Unlike the prior art, the present invention does not rob power directly from the loudspeaker, but instead utilizes the relationship between the natural movement of the speaker cone, the speaker enclosure and the differential flow vents in a cost-effective manner to create preferential air flow through the enclosure.

Furthermore, the current invention uses defined and purposeful non-linearity to do desired work, yet without adversely affecting normal vent operations. In particular, the differential flow vents are placed within the enclosure to prevent and to minimize extraneous noises and distortion, such as whistling or spurious tones caused by complex flow patterns when cooling a woofer. This invention also overcomes the modifications suggested in the prior art to the woofer structure, speaker frame, and pole pieces in an attempt to minimize extraneous noises. Additionally, this invention avoids the problems of the prior art where the amount of attempted air movement is so great and involved that it is possible that the woofer would be rendered unfit for normal use.

Still further, the present invention provides an implementation which is much simpler and less costly to manufacture. A backplate of a woofer assembly manufactured with differential flow vents is much simpler and cheaper to manufacture than the structures suggested by the prior art because to directly cool the woofer assembly merely requires drilling or incorporating straight holes through the rear plate or possibly the front plate and constructing the differential flow vents by inserting a simple small molded insert as the flange piece. Any flanges used in this invention are substantially less involved than the molded piece of the prior art, and alternately, they may be extruded for manufacturing economy. These methods are applicable not only to placing vents in the woofer backplate structure, but to the loudspeaker enclosure also. No other modifications to the standard loud speaker and magnetic structure are required, as opposed to complex custom die-casting of the frame, pole piece and front plate as seen in the prior art.

Lastly, the present invention accommodates smaller speakers like midrange speakers and large format compression tweeters, whereas with the prior art, due to size and complexity, changes to a typical speaker structure are constrained by any remaining space available.

Other objects and advantages will be apparent from the specification and drawings which follow.

BRIEF DESCRIPTION OF THE DRAWINGS

FIG. 11*a* shows a longitudinal cross-sectional view of a speaker having differential flow vents in the backplate and a foam resistance plug, while

FIG. 13*a* shows a longitudinal cross-sectional view of a speaker having differential flow vents in the backplate, while

DETAILED DESCRIPTION OF THE INVENTION

Figure 2A:
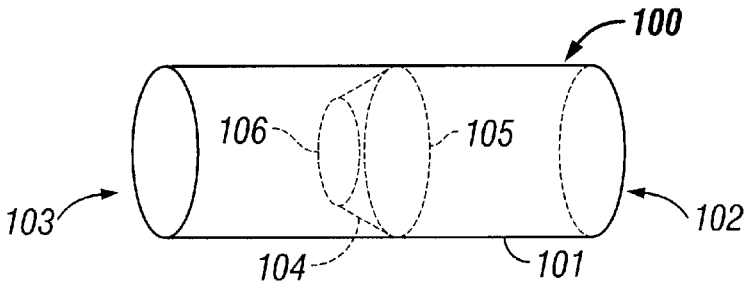
FIGS. 2*a,* 3*a,* 4*a,* 5*a,* and 6*a* each schematically shows a perspective view of various embodiments of the differential flow vents of the present invention, while FIGS. 2*b,* 3*b,* 4*b,* 5*b*, 6*b* each schematically shows the corresponding longitudinal cross-sectional view.
Figure 2B:
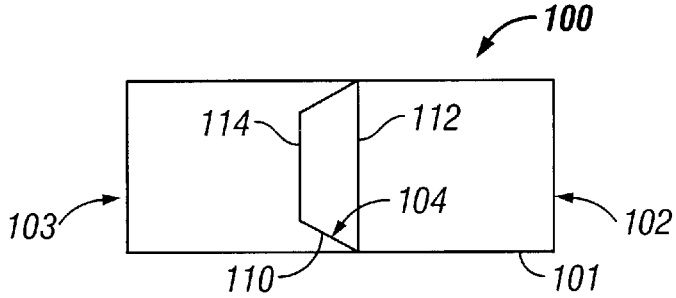

The present invention will now be described in greater detail with reference to the accompanying drawings. Referring to FIGS. 2*a–b*, a differential flow vent 100 has a tubular body 101 extending longitudinally from an inlet end 102 to an outlet end 103. The tubular body may be made from a plastic material, a metallic material, wood, or any other feasible material. What makes tubular body 101 function as a differential flow vent is the inclusion of a tapered portion or flange 104 that takes up a portion of the cross-section of the body, thereby making airflow in the vent non-linear because of the Venturi effect created by the tapered flange. The tapered flange has a first end 105 and an opposite end 106. The cross-sectional area of end 105 is greater than the cross-sectional area of end 106, thereby producing a greater resistance to airflow in a direction from end 103 to end 102 of tubular body 101. This accordingly provides preferential airflow in a direction from end 102 to end 103 of the tubular body.

Figure 7A:
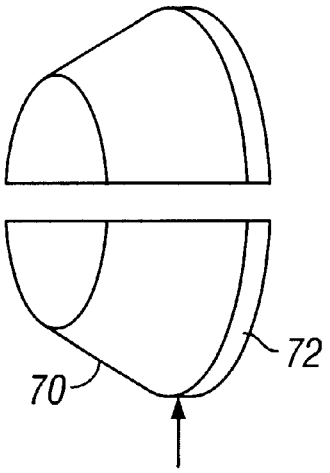
FIGS. 7*a–b* each shows a longitudinal cutaway perspective of flanges causing different degrees of non-linearity in the differential flow vents of the present invention.
Figure 7B:
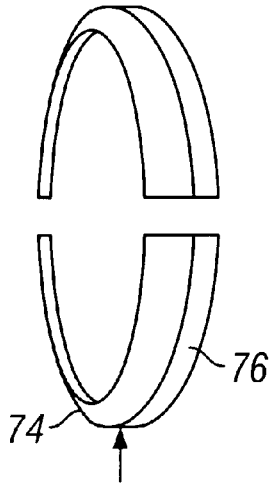

In FIGS. 2*a–b*, flange 104 has a generally frusto-conical body 110 extending between opposite ends having a first cross-sectional area 112 and a smaller second cross-sectional area 114. The flange may be made from a separate piece adhered to the interior of tubular body 101. FIGS. 7*a–b* show examples of two flanges 70 and 74 having frusto-conical bodies joining with cylindrical portions 72 and 76, respectively, for mounting an the interior of the tubular body. The operation and structure of flanges 70, 74 will be discussed in detail later. Alternately, the flange may be extruded from the same material as body 101 or made in any commercially known manner.

Figure 3A:
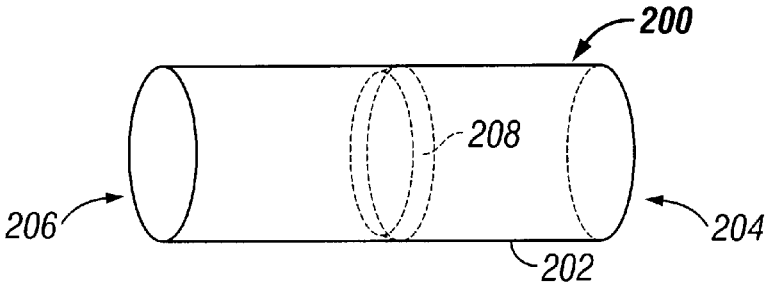
Figure 3B:
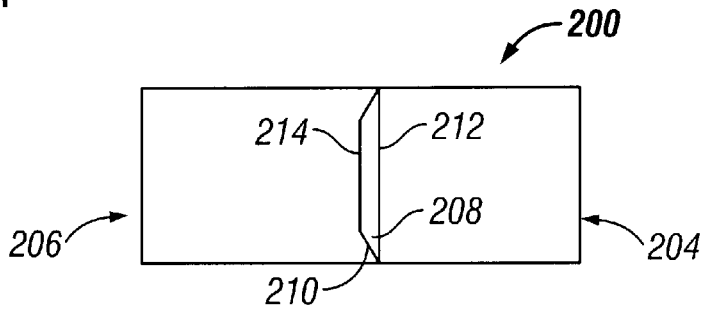

A differential flow vent does not require a large amount of change in cross-sectional area in order to be effective, nor a great reduction in vent area. Referring to FIGS. 3*a–b*, a similar differential flow vent 200 comprises a tubular body 202 which extends from an inlet end 204 to an outlet end 206. Alternately, the tubular portion of the vent may be a bore drilled through the speaker cabinet enclosure. Flange 208 is disposed within body 202 and has a generally frusto-conical body 210 extending between opposite ends having a first cross-sectional area 212 and a smaller second cross-sectional area 214. The tubular body has an overall length and a tapered portion having a length which is substantially less than the overall length of the body. In general, air flows preferentially from inlet end 204 towards outlet end 206.

Figure 4A:
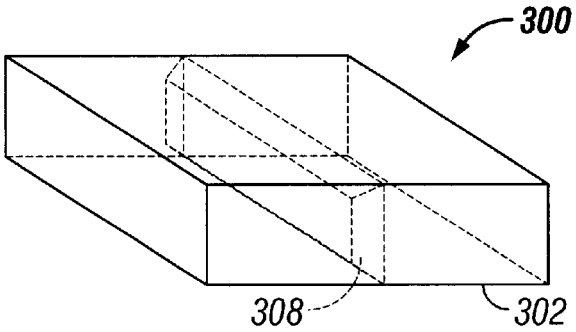
Figure 4B:
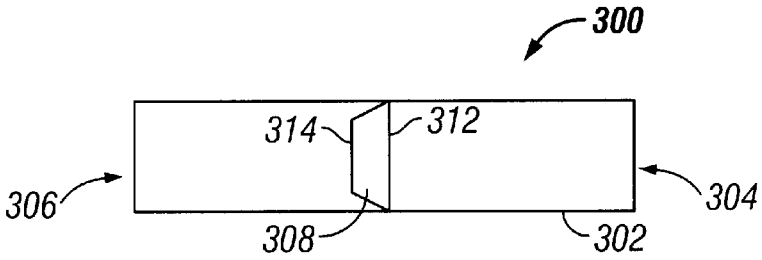
Figure 5A:
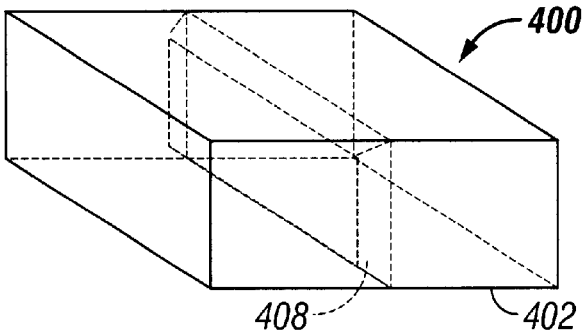
Figure 5B:
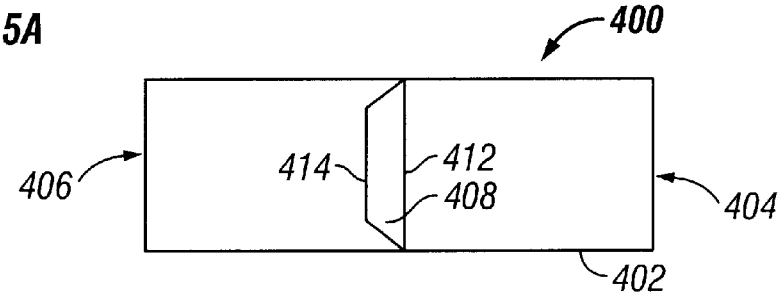

Referring to FIGS. 4*a,b*–5*a,b,* the structure of differential flow vents 300 and 400 are similar and will be described together. Differential flow vents 300, 400 each has a tubular body 302, 402 respectively, and rectangular cross-sectional areas. While the cross-sectional areas and structures may be different, the function of these vents are similar to vents 100, 200. Differential flow vents 300, 400 each respectively has an inlet end 304, 404 and an outlet end 306, 406.

Flanges 308, 408 are disposed within vents 300, 400, respectively. Flanges 308, 408 each have a tapered body extending between opposite ends having a first cross-sectional area 312, 412, respectively, and a smaller second cross-sectional area 314, 414, respectively. In general, the preferential airflow is from inlet end 304, 404 towards outlet end 306, 406, respectively. Flanges 308, 408 may be manufactured from several separate pieces.

Figure 6A:
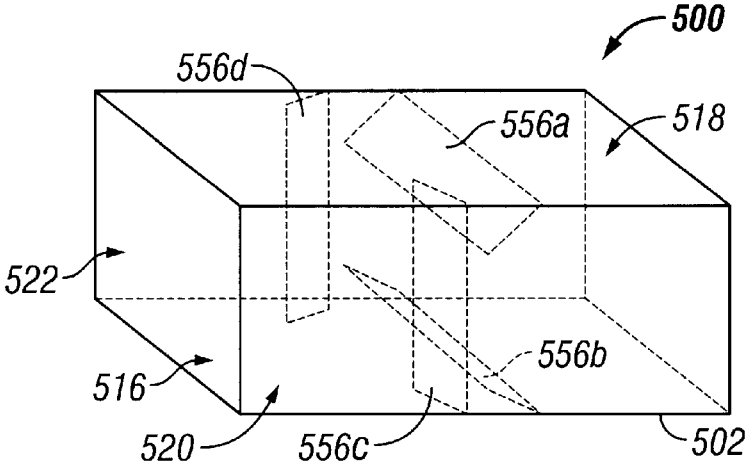
Figure 6B:
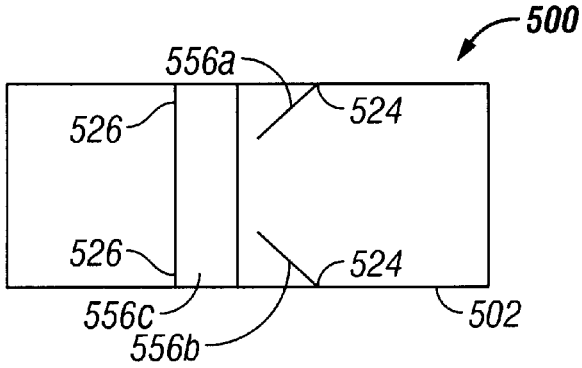
Figure 8A:
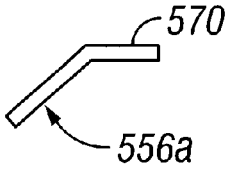
FIGS. 8*a–c* respectively show a side view, isometric perspective view and an elevation of a molded flange for a rectangular shaped differential flow vent of the present invention.
Figure 8B:
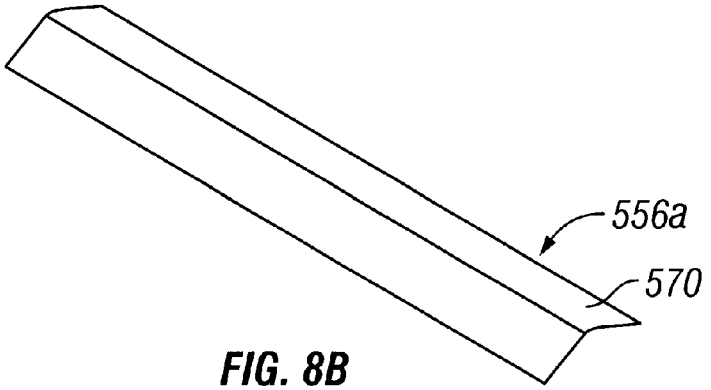
Figure 8C:
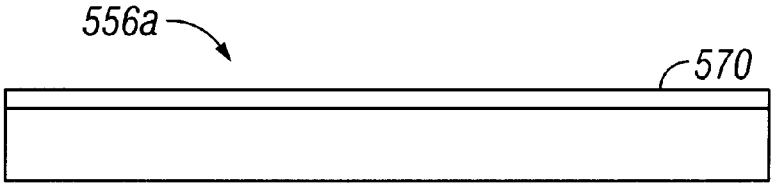

Turning to FIG. 6*a–b*, a flange may be formed from four separate pieces 556*a–d* adhered or attached to the interior of a differential flow vent 500. Differential flow vent means in this embodiment includes a first pair 516, 518 of generally parallel spaced walls and a second pair 520, 522 of generally parallel spaced walls extending substantially perpendicular to the first pair of walls. The differential flow vent means comprises a pair of flanges 556*a* and 556*b* defining a first end tapering toward one another from the first pair of walls 516 and 518. A second pair of flanges 556*c* and 556*d* are spaced from the first pair of flanges and taper toward one another from the second pair of walls 520 and 522. FIGS. 8*a–c* shows how one of these pieces, for example 556*a,* may be molded to define a surface 570 for mounting and being attached to the interior wall of the differential flow vent 500. Alternately, the flange may be extruded from the same material as body or enclosure 502, namely, extruded from a fairly flexible material that could be cut to length, or made in any commercially known manner. It should be understood that the flanges 556*a–d* operate in a manner similar to the configuration shown in FIG. 4*a* to provide a similar result. Alternatively, one pair of vents mentioned above, or even a single flange may be used to provide a similar result.

Although the cross-sectional shapes of the vents shown in FIGS. 2–6 represent the best approaches, these do not preclude using the other shapes or arrangements, such as triangles or ovals. It is further possible to utilize existing vents of sufficient size to obtain preferential airflow by having a flange as shown in FIGS. 7*a* or 7*b* molded from a separate somewhat flexible plastic or other suitable material, and by adhering it in place inside an existing conventional vent. This would entail using existing stock parts and tubes without having to have a complete and separate part molded, thereby saving on tooling, inventory and storage costs.

In order to cool a loudspeaker system, a differential flow vent may be placed within the cabinet enclosure. While a single vent may be used by itself, the result would be a net displacement of air from inside the vented cabinet (depressurization) or a net intake of fresh air into the cabinet (pressurization). This by itself would cause an ideal woofer, that is, one no dynamic offset, to be displaced from its average nominal rest position and thereby introduce distortion and non-linearity within the loudspeaker system. Typically, loudspeaker vents have strived to be as symmetrical and linear as possible in order to minimize distortion and to maximize the desired vent output. If any non-linearity is introduced by a vent, the results are normally considered to be bad and undesirable because the woofer could become dynamically offset and forced from the position of the average centering in the gap.

However, still considering the situation of the ideal woofer, if a pair of differential flow vents were used in tandem, with one having a net airflow into the cabinet, and one having net airflow out of the cabinet, then any non-linear effects would cancel. But this would be contrasted with the situation where the combination of intake and out-take differential flow vents are balanced to be equal so that any nonlinearities due to the directional airflow action would cancel when used in tandem; such a configuration of differential flow vents would act exactly as the conventional intake and out-take vents of the prior art.

Figure 9:
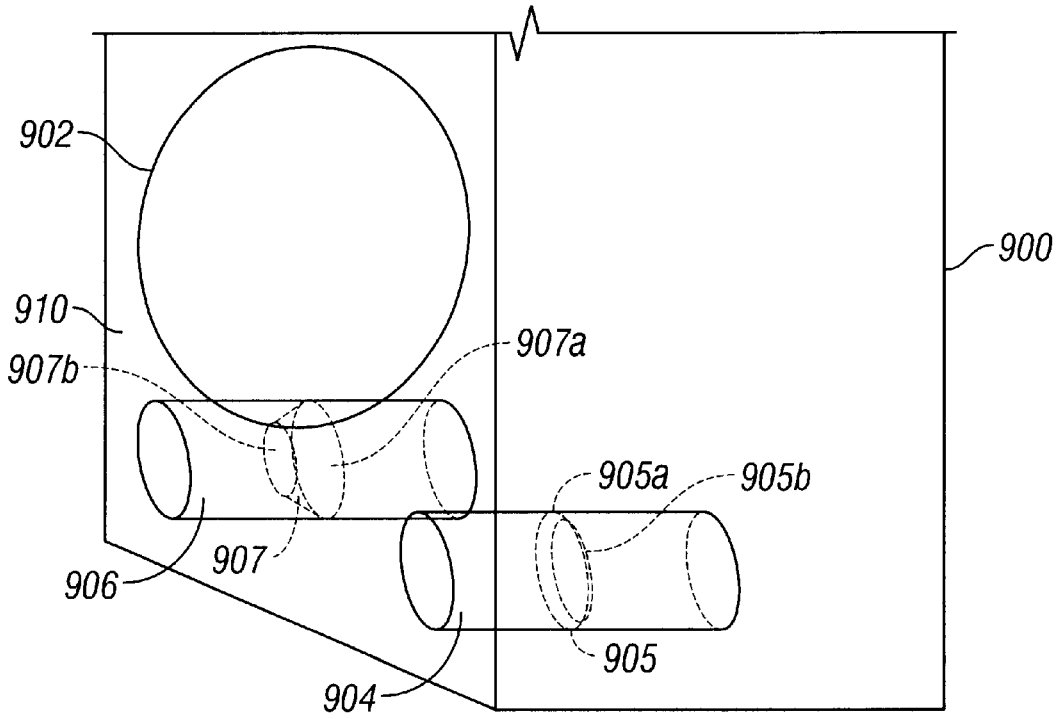
FIG. 9 shows a schematic perspective view of a pair of opposed asymmetrical differential flow vents for depressurizing the speaker enclosure, thus compensating for inherent forward movement of the woofer.

In the practical world, a woofer is not always ideal, and although using a pair of opposed symmetrical differential flow vents would provide a way to cool the enclosure, it would not aid in compensating for the acoustical distortion caused by the non-ideal woofer as will be discussed in detail later. Referring to FIG. 9, differential flow vents 904, 906 are used in a loudspeaker cabinet enclosure 900 which supports a woofer assembly 902. The enclosure is commonly found in speaker cabinets of the prior art. The enclosure is substantially closed to define an interior space where cabinet air resides. The differential flow vents provide communication between the cabinet air space and ambient air. Although these vents are shown to be placed on the front baffle 910, they may be located anywhere a normal vent could be located on a speaker enclosure. The pair is opposed in that it comprises an intake differential flow vent 904 and an out-take differential flow vent 906. The pair is asymmetrical in that one vent is slightly less air flow preferential than the other. In particular, intake vent 904 is mildly preferential in comparison to out-take vent 906. These differential flow vents provide a greater resistance to airflow in one direction from the second smaller cross-sectional area to the first cross-sectional area than in the opposite direction.

By controlling the nonlinearity of each differential flow vent comprising the pair, the control of airflow pumped into and out of the cabinet enclosure may be varied. With the differential flow vents placed in opposed directions, the same stale air is not merely oscillated or circulated within the loudspeaker enclosure as in the prior art. Rather, the enclosure is ventilated because air is positively pumped in a definite manner into, throughout, and out of the enclosure with the natural motion of the woofer speaker cone. By making the preferential flow of each vent comprising the pair to be asymmetrical, a different amount of air flows into the enclosure than out of the enclosure with the natural motion of the speaker cone acting as a pump. This provides a way to control the air circulation for cooling the cabinet enclosure. The relationship between the opposed asymmetrical pairs of differential flow vents effectively allows the enclosure to be pressurized or depressurized with the natural motion of the cone. This structure overcomes the situation with vented cabinets of the prior art, where under ideal conditions the air in the vent merely moves back and forth like a coherent entity or a slug of air, and where there is no definite net air movement since the air inside the cabinet is essentially the same stale air with only a small portion of it moving back and forth in the vents.

In order for there to be a net airflow to cool the cabinet enclosure, the preferential airflow does not have to be total or maximum as the vents in the prior art suggests. As long as the air inside the cabinet is changed several times an hour, it will not have time to heat up or cause the woofer magnet or any powered electronics to heat up too much. This means that the amount of preferential flow can be relatively mild, instead of maximum. To achieve mild preferential flow in a differential flow vent, the flange can be relatively short taking up less of the total vent area, and allowing the vent to function in its normal capacity of tuning and abetting bass response, all the while providing net air movement through the cabinet. A square tubular cross-sectional area would lend itself to typical wooden shelf vents as used in vented loud speaker cabinets of the prior art, and the multiple flange version might maximize the air pumping effect.

In another embodiment, not shown, multiple pairs of opposed asymmetrical differential flow vents are placed in the speaker enclosure for cooling the cabinet. They may be located wherever a normal vent could be located in a speaker enclosure. Alternately, an odd number of opposed differential flow vents are used like that shown in FIG. 10. A cabinet enclosure 800 supports a woofer assembly 802. Two intake differential flow vents 804, 806 and an out-take differential flow vent 808, each of which are mildly flow preferential, provide air communication between the interior and the exterior of the cabinet.

Besides cooling the enclosure, differential flow vents may be used to counteract the non-ideal woofer, in particular, one that has a natural tendency to offset. When a woofer exhibits dynamic offset, it tends to cause the voice coil to no longer be centered on average, and the portion of the voice coil that remains furthest away from the magnetic gap gets hotter than the rest of the voice coil, causing added stress and potential for failure. Whereas with the ideal woofer, a single preferential differential flow vent may be used to correct a woofer that is distorted and has moved away from an average nominal rest position. This would normally be considered detrimental, but woofers tend to do this to a certain extent with speaker systems and it is usually a sign of the vents not being large enough to allow symmetrical and linear airflow action. Economic considerations make using a smaller than optimal sized vent desirable, so a certain amount of uncontrolled dynamic woofer offset tends to occur in real world market designed systems at high power levels. Using a single mildly preferential differential flow vent to control and correct for the natural tendency of a woofer to exhibit dynamic woofer offset would correct this. For example, in a particular system design where a woofer has the natural tendency to move forward or backward, once such direction is determined, the extent of the uncontrolled dynamic woofer offset may be corrected with a single mildly preferential differential flow vent as in FIGS. 3*a–b*. Differential flow vent 200 has a flange 208 disposed within. The use of this differential flow vent would in turn help keep the woofer voice coil more nearly centered in the magnetic gap, increasing power handling and reliability under high drive conditions. By being centered, the voice coil can transfer heat to the magnet structure since it will be in close proximity to the front plate and magnetic gap. Moreover in many systems, vents that are smaller than theory dictates tend to cause the woofer's average position to come forward with the center of the average back and forth woofer motion moving forward. However, a mildly preferential vent that pumped air "out" of the enclosure cabinet would tend to offset this tendency despite the smaller than optimal vent as in FIG. 3.

In effect, using a single mildly differential flow vent capitalizes upon the concept of a controlled and defined nonlinearity to offset another nonlinearity. Establishing a defined amount of control along with a fairly small amount of air pumping will counteract an inherent woofer offset under high-drive conditions. As a practical consideration, the amount of nonlinearity in the differential flow vent would have to be fine tuned for each speaker cabinet and woofer, as it would be very system specific. Once the proper amount of preferential airflow action required to minimize the dynamic woofer offset for a particular model speaker system is determined, that model of speaker system would be characterized and need no further attention, since the optimum amount of preferential airflow would be applied to each unit in the same manner.

Opposed asymmetrical differential flow vents, whether used in pairs or in an odd number combination, may additionally be used not only to cool the speaker enclosure, but to correct a woofer offset more effectively than with a single vent. By varying the nonlinearity of these vents, the amount of pressurization or depressurization of the enclosure may be controlled in order to correct the woofer offset. In particular, one of the vents comprising the pair provides greater resistance to airflow from ambient air into the cabinet air space, and the other vent comprising the pair provides greater resistance to airflow from the space to ambient air. Between the pair, the resistance to airflow of one of the vents is greater than that of the other.

Referring to FIG. 9, intake differential flow vent 904 has a flange 905 disposed within, wherein the vent has a greater resistance to airflow escaping the cabinet space into ambient air. Flange 905 has a first cross-sectional area 905*a* and a smaller cross-sectional area 905*b*. Out-take differential vent 906 has a flange 907 disposed within, wherein the vent has a greater resistance to airflow entering the cabinet space from ambient air. Since vent 904 has less preferential airflow than vent 906, the arrangement shown in FIG. 9 provides a way to depressurize the enclosure in order to compensate for a woofer that has an inherent forward movement or offset; the overall depressurization will return to the woofer to its central location.

Figure 10:
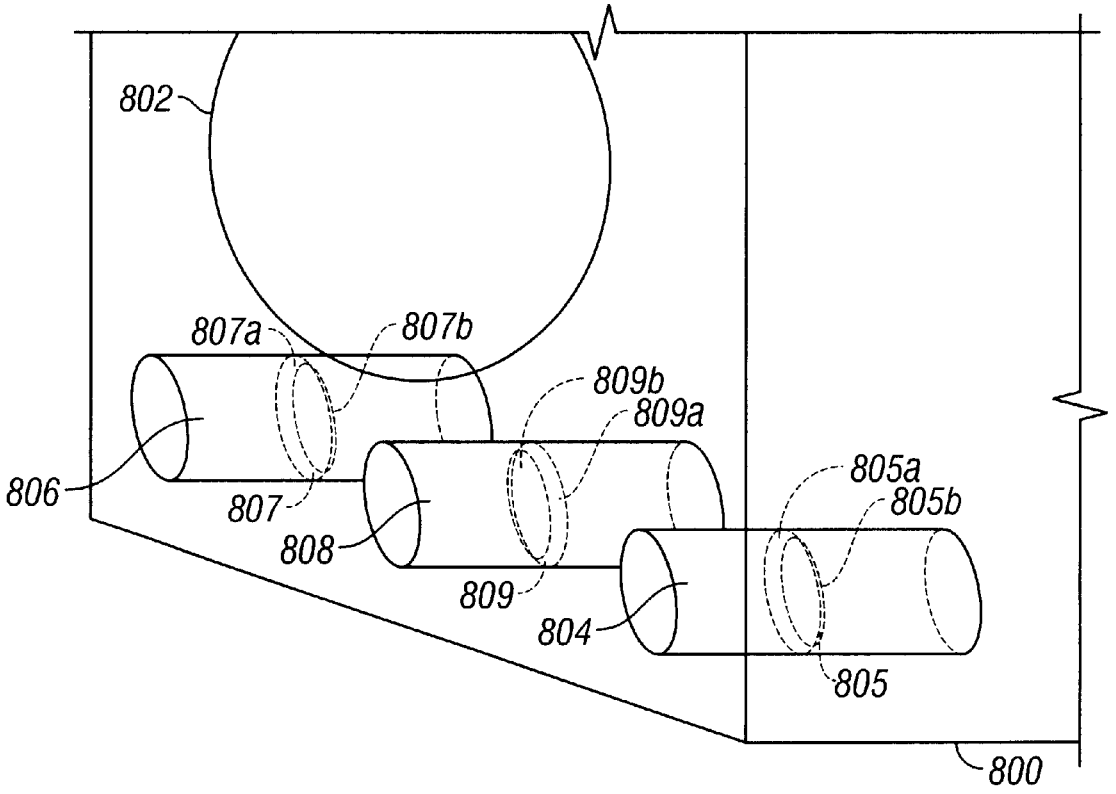
FIG. 10 shows a schematic perspective view of an odd number of opposed mildly differential flow vents for pressurizing the speaker enclosure, thus compensating for inherent rearward movement of the woofer.

Another example illustrates how a woofer offset may be compensated by using an odd number of differential flow vents by merely providing an additional differential flow vent to a pair of vents. Referring to FIG. 10, the intake differential flow vent 804 has a flange 805 disposed therewithin. The intake differential flow vent 806 has a flange 807 disposed therewithin. These vents have a greater resistance to airflow escaping the cabinet space. Flange 805 has a first cross-sectional area 805*a* and a smaller cross-sectional area 805*b*. Flange 807 has a first cross-sectional area 807*a* and a smaller cross-sectional area 807*b*. The out-take differential vent 808 has a flange 809 disposed within, wherein the vent has a greater resistance to airflow entering the cabinet space from ambient air. Flange 809 has a first cross-sectional area 809*a* and a smaller cross-sectional area 809*b*. Accordingly, this example provides a way to pressurize the enclosure in order to compensate for a woofer that has an inherent rearward movement or offset; the overall pressurization will return to the woofer to its central location. Additionally, woofer dynamic offset nonlinearities due to the suspension could also be directly compensated for by using either odd numbers of opposed symmetrical vents or at least one pair of opposed asymmetrical vents.

According to the present invention, the creation of a slight imbalance from using a combination of opposed mildly preferential asymmetrical vents counteracts the natural tendency of the woofer offset or even nonlinearities caused by the cabinet or existing vent. Essentially, this combines the use of the air pumping principle discussed previously with a nonlinearity correction principle. The pairing of opposed asymmetrical differential flow vents essentially functions as proper acoustical elements in the system design, unlike other uncontrolled openings of the prior art, such as air leaks that cause an acoustical short circuit of the intended vents, thereby changing their tuning significantly or reducing the air pump function.

Figure 1:
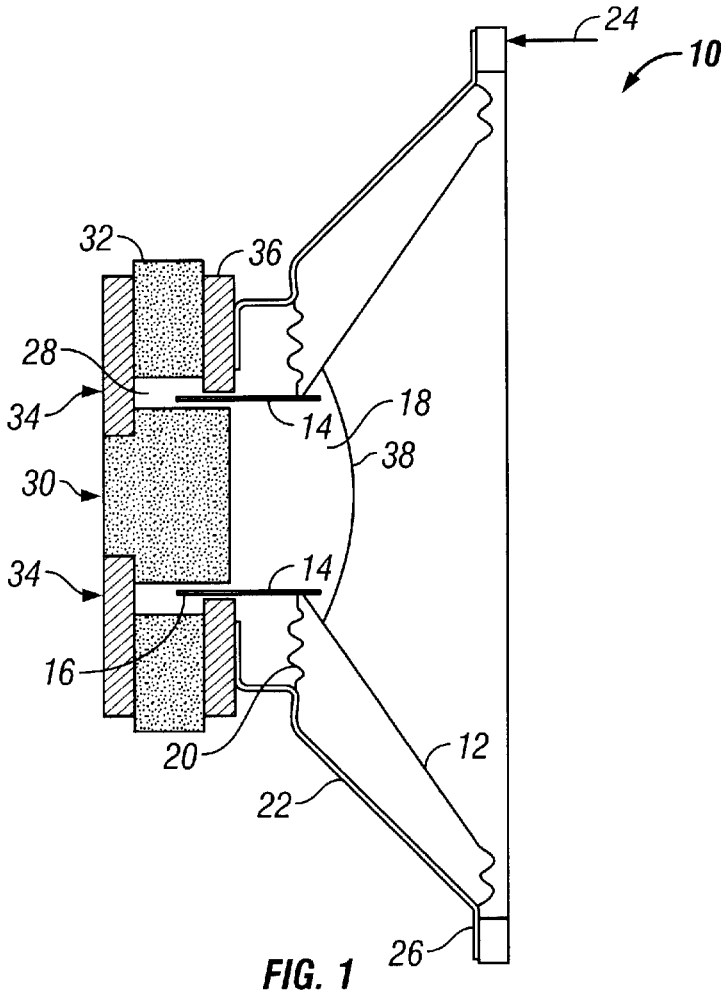
FIG. 1 (Prior Art)
FIG. 1 is a cross-sectional view of a loudspeaker of the prior art.
Figure 13A:
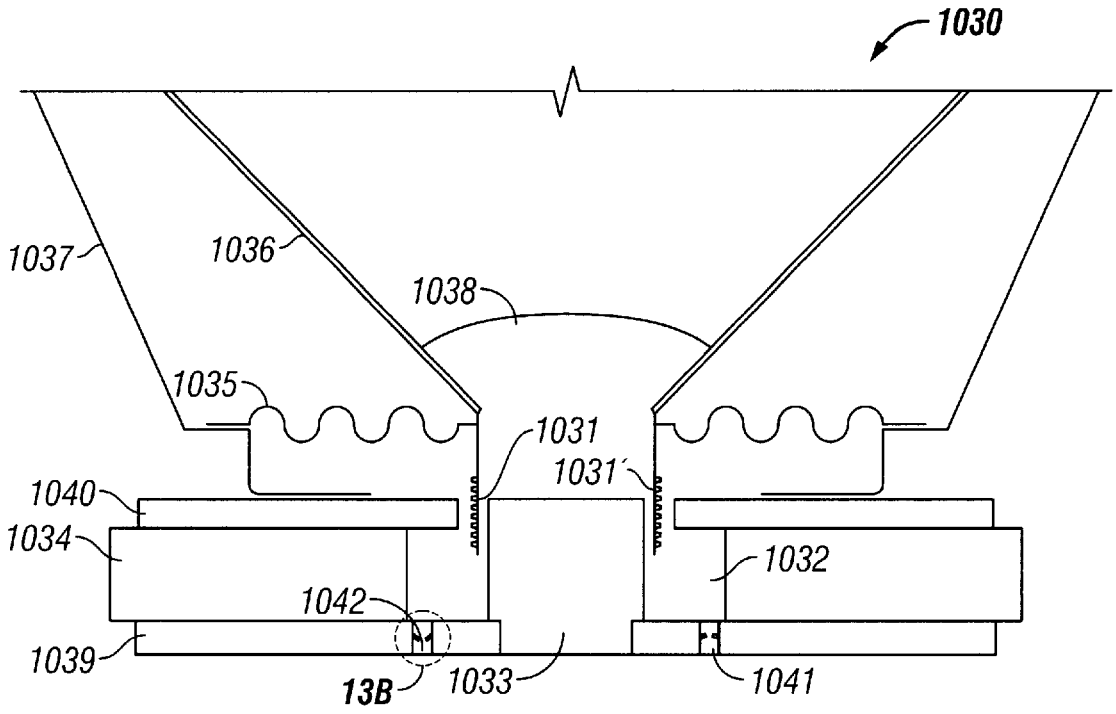
Figure 13B:
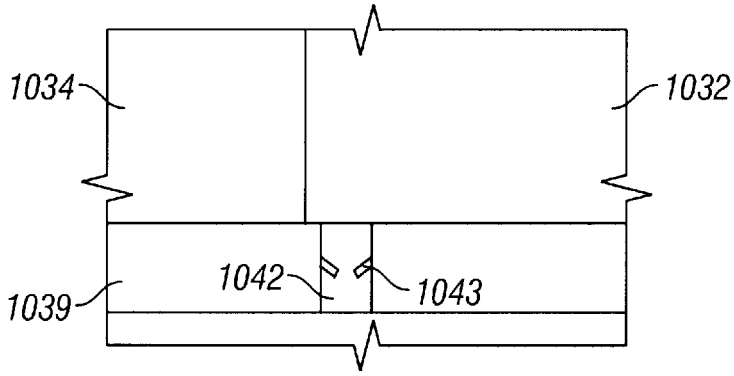
FIG. 13*b* shows an enlarged view of a differential flow vent.

The pumping action created by the natural motion of the speaker cone along with a pair, or pairs of opposed differential flow vents may also be used for directly cooling a speaker magnet structure in addition to cabinet enclosure cooling. Referring to FIGS. 13*a* and 13*b*, a conventional woofer assembly speaker 1030 is shown having components similar to that described in FIG. 1. Woofer assembly speaker 1030 includes a voice coil 1031 comprising a generally annular electrical winding disposed about an annular hub 1031' and supported by the speaker cone 1036. Hub 1031' is secured to a flexible spider 1035 and the speaker cone which is vibrated by the voice coil. Spider 1035 interconnects the annular hub to basket 1037, which acts as a frame support. The voice coil is disposed within an annular air gap or air chamber 1032, which is defined by the center solid pole piece 1033 and the magnet structure. Disposed within the air gap 1032 is an unvented center solid pole piece 1033, which is positioned coaxially of the voice coil. An annular magnet 1034 is cooperable with the pole piece and is disposed about the air gap. The magnet structure drives the speaker cone in respone to electrical signals applied to the coil as is conventionally known. A dust cap 1038 is positioned over the distal end of the voice coil and is affixed to the speaker cone. A backplate 1039 and a front plate 1040 provide structural support for interconnecting the magnet with the basket and pole piece as shown.

The woofer assembly speaker operates in a conventional manner, where an electrical signal is applied to the voice coil. In turn, the voice coil former 1031' and the voice coil vibrate along the axial direction, which in turn causes the speaker cone 1036 to vibrate thereby converting the electrical signals into an acoustical sound waves. As discussed in the prior art, the electrical winding comprising the voice coil increases in temperature and heats up the speaker and enclosure. While many woofers have a vented magnet system of one type or another, this venting suffers from the same problem that speaker cabinet vents do, namely, the air merely moves back and forth in place and never really flows in a definite direction. If it did, the woofer would be dynamically offset due to the nonlinearity of the venting.

With the present invention, portions of the woofer magnet structure have been modified to include differential flow vents disposed within the backplate to provide communication between the air chamber and the exterior of the loudspeaker or woofer assembly. Differential flow vent means may include a plurality of elongated passages, each of which has a differential flow vent therein. With a pair of these vents, one of the vents provides greater resistance to airflow from the cabinet air space exterior to the loudspeaker assembly into the air gap or chamber; the other vent provides greater resistance to airflow from the chamber to the exterior of said assembly. The differential flow vents induce positive airflow between the cabinet enclosure and air gap 1032 for cooling heated components of the woofer. By providing a pair, or pairs of differential flow vents in the backplate of the speaker magnet structure, the natural motion of the cone may be used as pump, thereby incorporating cabinet air exchange for direct woofer air cooling.

Figure 12:
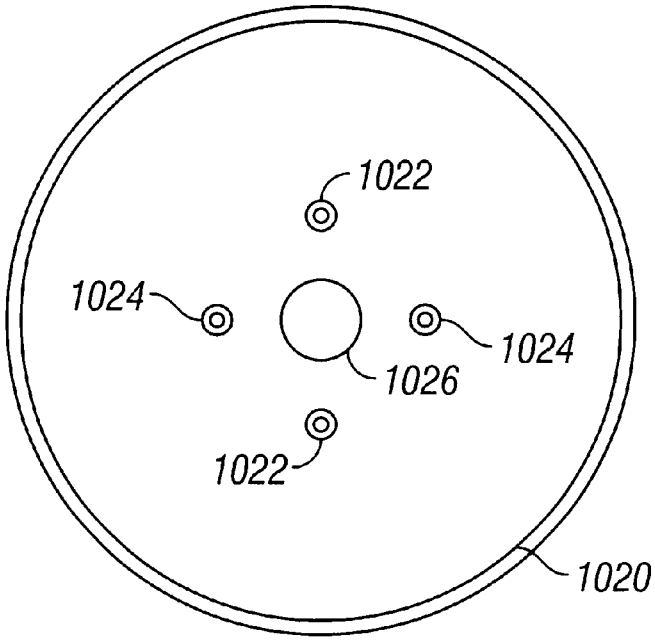
FIG. 12 shows a bottom view of the woofer backplate with two pairs of differential flow vents of the present invention.
Figure 14:
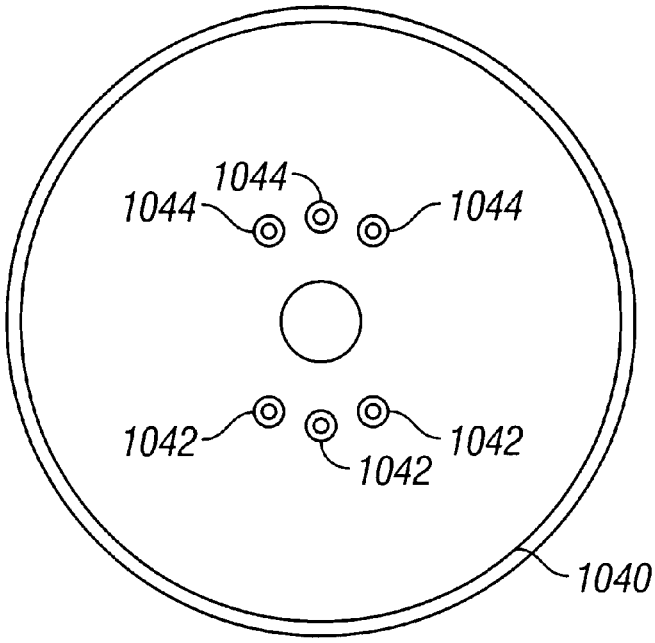
FIG. 14 shows a bottom view of the woofer backplate with three pairs of differential flow vents of the present invention.

To accomplish the foregoing, an intake differential flow vent 1041 and an out-take differential flow vent 1042 provide airflow communication between the air gap 1032 and the cabinet enclosure so that cabinet air is pumped preferentially to circulate through and cool the magnet structure. To provide cooling of the magnet structure, the pair of vents may be opposed symmetrical differential flow vents. To additionally provide woofer offset compensation, the pair may be opposed asymmetrical differential flow vents. While these figures show the differential flow vents in the back plate of the magnet structure, they could be placed on the front plate, or in other locations on the magnetic structure. Multiple pairs may be used as shown in FIG. 12. A backplate 1020 has two pairs of opposed differential flow vents comprising intake vents 1022 and out-take vents 1024, which are arranged around the center pole piece 1026 so that air flow is made more effective by providing cross-flow between the pairs. Similarly, any number of pairs could be used in various arrangements for maximizing air flow through the magnet structure in order to maximize cooling. These configurations effectively allow a plurality of vents to provide greater resistance to airflow from the exterior of the assembly into the chamber, and a plurality of vents to provide greater resistance to airflow from the chamber to the exterior of the assembly. FIG. 14 shows backplate 1040 with three pairs of differential flow vents comprising intake vents 1042 and out-take vents 1044 arranged around a center pole piece 1046. The differential flow vents may be drilled through the backplate as an inexpensive process step during the machining of the backplate.

As shown in FIG. 13*b*, a flange 1043 is small and would not have to be machined into the magnet structure, but could be a molded plastic insert that friction fits into place or is locked into place using a raised ridge on the outer circumference of the molded plastic vent that mates with a groove in the magnet structure hole. As described previously, the flow vents may include a tapered portion having a first end and an opposite second end, where the second end defines a cross-sectional area smaller than the cross-sectional area of the first end. The tapered portion may be of a generally frusto-conical configuration.

Figure 11A:
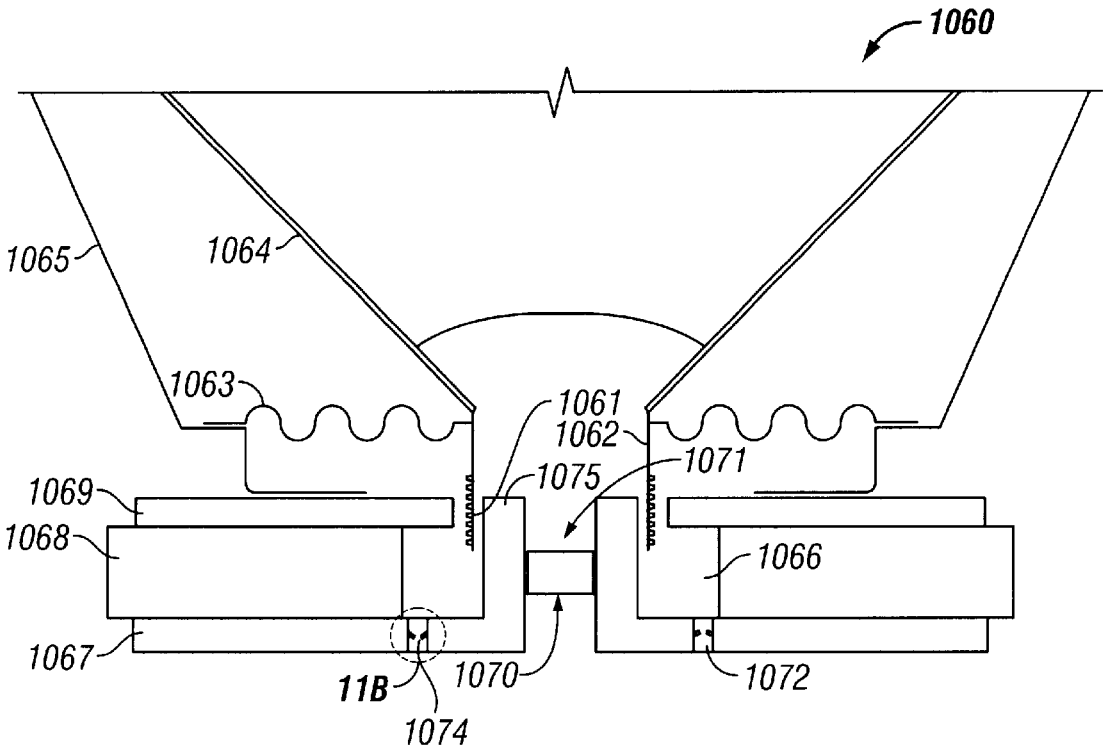
Figure 11B:
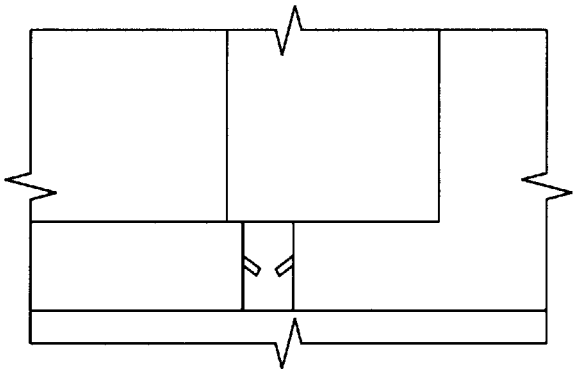
FIG. 11*b* shows an enlarged view of a differential flow vent.

Referring to FIGS. 11*a–b*, a preferred embodiment of a conventional woofer assembly speaker 1060 is shown having components similar to that described in FIG. 13. Woofer assembly 1060 includes a voice coil 1061 disposed around an voice coil former 1062. Former 1062 is secured to a flexible spider 1063 and speaker cone 1064. Spider 1063 interconnects the annular hub to basket 1065, which acts as a frame support. The voice coil is disposed in annular gap 1066, which is disposed of the voice coil. The air gap is also bounded by a portion of backplate 1067, annular magnet 1068 and a front plate 1069. Front plate 1069 and backplate 1067 provide structural support for interconnecting the magnet with the basket as shown. Intake differential flow vent 1072 and out-take differential flow vent 1074 provide airflow communication between air gap 1066 and the cabinet enclosure so that cabinet air is pumped preferentially to circulate through and to cool the magnet structure. Backplate 1067 is modified to be integral with an annular pole piece 1075, which includes a center bore 1071 extending through the annular hub. Bore 1071 provides communication between said voice coil space and the exterior of the assembly. An airflow resistance member or plug 1070 formed from a flexible foam material is disposed within bore 1071 and made from a material allowing high but linear airflow resistance in order to force some of the air pressure to be pumped through the differential flow vents.

By using opposed symmetrical pairs of differential flow vents in the backplate of FIG. 11, center vent efficiency may be slightly reduced, but to a lesser degree than any other implementation shown in the prior art. Additionally, no external power is required and loss of vent efficiency is minimized.

By this invention, the direct air cooling of the magnet structure is not limited to woofers, but may also be used with midrange drivers that handle higher amounts of power such as 6½ inch diameter units, or other loudspeakers magnet structures having enough room to accommodate at least a pair of differential flow vents. These vents need only to be around a ¼ to ⅓ inch in outside diameter and up to the largest size that would fit inside a magnet cavity outline.

It is also possible that large format four inch professional compression drivers could be cooled in this manner, since they typically have a large magnetic structure with enough space for the differential flow vents. These are devices in the form of drivers known for converting an electrical signal into acoustical energy and sound waves, and for radiating sound waves into air. These devices may be generally categorized into direct radiators and indirect radiators. The former directly radiates the generated sound waves, whereas, the latter calls for additional elements for radiating the generated sound waves. Typically, a driver arrangement may include a conductor for generating an electrical signal and may be embodied as a coil of thin wire mechanically connected to a flexible diaphragm and positioned in a magnetic field. When electrical current passes through this coil, mechanical forces are exerted upon the coil so as to cause the diaphragm to move and vibrate, thereby generating sound waves. In the case of a direct radiator, surrounding air is directly vibrated and moved by the diaphragm in the generation of sound waves related to the electrical signal. By comparison, in an indirect radiator, the diaphragm moves against a surface which is within closely spaced proximity. High pressure compression waves are generated and then passed on to a throat, horn or other acoustic generator which has a smaller upstream area than the diaphragm. In general, compression drivers, like those used in a public address system, are a type of indirect radiators which may generate higher audible levels when compared with direct radiators.

In particular, larger tweeters such as the four inch diaphragm compression drivers used for professional sound reinforcement, could benefit from a non-linear form of air pumping vent by helping compensate for the inherent "compression distortion" that they experience at high drive levels. This would be different from the woofer dynamic offset correction which may result from net air displacement problems, whereas with compression drivers which actually begin to compress the air in an asymmetrical fashion. Since the vents would not required to be incorporated into the magnetic structure of the compression driver, they could be incorporated into the rear chamber or cover of the conventional compression driver, and any size limitations would be eliminated. As a practical consideration, they would probably have to be different than the woofer vent inserts, as they might require a smaller vent size in order to function properly.

In yet another embodiment, the combination of differential flow vents provided both in the speaker enclosure and in the woofer magnet structure would provide maximal cooling of the loudspeaker. In providing a distinct and positive air flow through the cabinet, the differential flow vents placed in the cabinet might consist of a pair of opposed asymmetrical differential flow vents compensating for any woofer offset. Within the woofer magnet structure, at least a pair of opposed symmetrical differential flow vents may be used for direct cooling purposes. With this approach or system, a doubling of the effectiveness of the principle in the system may be achieved.

Although particular embodiments of the invention have been described in detail herein with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. A loudspeaker device with differential flow vent means comprising an enclosure and a loudspeaker assembly, said enclosure being substantially closed to define an interior space for substantially encompassing said loudspeaker assembly within said space, differential flow vent means providing communication between said space and ambient air, said flow vent means defining a first cross-sectional area and a second cross-sectional area smaller than said first cross-sectional area for producing a greater resistance to airflow in one direction from said second cross-sectional area to said first cross-sectional area than in the opposite direction.

2. A loudspeaker device as defined in claim 1, wherein said differential flow vent means comprises a tapered portion having a first end and an opposite second end, the first end defining said first cross-sectional area and the second end defining said second cross-sectional area.

3. A loudspeaker device as defined in claim 2, wherein said differential flow vent means is disposed within said enclosure and has an overall length, said tapered portion having a length which is substantially less than said overall length.

4. A loudspeaker device as defined in claim 2, wherein said tapered portion is of generally frusto-conical configuration.

5. A loudspeaker device as defined in claim 4, wherein said tapered portion joins with a cylindrical portion.

6. A loudspeaker device as defined in claim 1, wherein said differential flow vent means includes a first pair of generally parallel spaced walls and a second pair of generally parallel spaced walls extending substantially perpendicular to said first pair of walls, said differential flow vent means comprises a plurality of flanges defining a first end and a second opposite end, said flanges comprising a first pair of flanges tapering toward one another from said first pair of walls and a second pair of flanges spaced from said first pair of flanges and tapering toward one another from said second pair of walls.

7. A loudspeaker device with differential flow vent means comprising an enclosure and a loudspeaker assembly, said enclosure being substantially closed to define an interior space for substantially encompassing said loudspeaker assembly within said space, a pair of differential flow vents, one of said vents providing greater resistance to airflow from ambient air into said space, and the other of said vents providing greater resistance to airflow from said space to ambient air, the resistance to airflow of one of said vents being greater than that of the other of said vents.

8. An enclosure as defined in claim 7, wherein the loudspeaker assembly is a woofer and when the woofer includes an inherent forward offset, said other vent has a greater resistance to airflow.

9. An enclosure as defined in claim 7, wherein the loudspeaker assembly is a woofer and when the woofer includes an inherent backward offset, said one vent has a greater resistance to airflow.

10. A loudspeaker device with differential flow vent means comprising an enclosure and a loudspeaker assembly, said enclosure being substantially closed to define an interior space for substantially encompassing said loudspeaker assembly within said space, a pair of differential flow vents, one of said vents providing greater resistance to airflow from ambient air into said space, and the other of said vents providing greater resistance to airflow from said space to ambient air, and an additional differential flow vent providing greater resistance to airflow from ambient air into said space.

11. A loudspeaker device with differential flow vent means comprising an enclosure and a loudspeaker assembly, said enclosure being substantially closed to define an interior space for substantially encompassing said loudspeaker assembly within said space, a pair of differential flow vents, one of said vents providing greater resistance to airflow from ambient air into said space, and the other of said vents providing greater resistance to airflow from said space to ambient air, and an additional differential flow vent providing greater resistance to airflow from said space into said ambient air.

12. A speaker assembly with differential flow vent means comprising a speaker cone having a central axis, a generally annular electrical winding supported by the speaker cone and forming a voice coil for vibrating the speaker cone, a pole piece positioned coaxially of said voice coil, a magnet structure cooperable with the pole piece for driving said speaker cone in response to electrical signals applied to the coil, said pole piece and said magnet structure defining an air chamber therebetween, a backplate for supporting the magnet structure and pole piece having a first surface exterior to the air chamber and a second surface opposite the first surface in communication with the interior of the air chamber, and differential flow vent means disposed within said backplate to provide communication between the air chamber and the exterior of said assembly, said differential flow vent means comprising a plurality of elongated passages extending through the back plate between the first and second surfaces, and being disposed substantially parallel to said central axis, each of said passages having a differential flow vent therein, one of said vents providing greater resistance to airflow from the exterior of said assembly into said chamber, and the other of said vents providing greater resistance to airflow from said chamber to the exterior of said assembly.

13. An assembly as defined in claim 12, wherein each of said flow vents comprises a tapered portion having a first end and an opposite second end, the second end defining a cross-sectional area smaller than the cross-sectional area of said first end.

14. An assembly as defined in claim 13, wherein said tapered portion is of generally frusto-conical configuration.

15. An assembly as defined in claim 12, including a plurality of vents providing greater resistance to airflow from the exterior of said assembly into said chamber, and a plurality of vents providing greater resistance to airflow from said chamber to the exterior of said assembly.

16. An assembly as defined in claim 12, including a voice coil space disposed within said voice coil, said pole piece being of annular construction and including a bore formed therethrough to provide communication between said voice coil space and the exterior of said assembly, and an air permeable airflow resistance member slidably disposed within said bore.

17. An assembly as defined in claim 16, wherein said airflow resistance member is formed of flexible foam material.

18. A loudspeaker device with differential flow vent means comprising an enclosure, said enclosure being substantially closed to define an interior space, first differential flow vent means comprising a pair of differential flow vents, one of said vents providing greater resistance to airflow from ambient air into said space, and the other of said vents providing greater resistance to airflow from said space to ambient air, the resistance to airflow of one of said vents being greater than that of the other of said vents, a speaker assembly supported within said space, said woofer assembly including a speaker cone having a central axis, a generally annular electrical winding support by the speaker cone and forming a voice coil for vibrating the speaker cone, a pole piece positioned coaxially of said voice coil, a magnet structure cooperable with the pole piece for driving said speaker cone in response to electrical signals applied to the coil, said pole piece and said magnet structure defining an air chamber therebetween, a backplate for supporting the magnet structure and pole piece, and second differential flow vent means disposed within said backplate to provide communication between the air chamber and said space, said second differential flow vent means comprising a pair of elongated passages and being disposed substantially parallel to said central axis, each of said passages having a differential flow vent therein, one of said vents of said passages providing greater resistance to airflow from said space into said chamber, and the other of said vents of said passages providing greater resistance to airflow from said chamber to said space.

19. A loudspeaker device as defined in claim 18, wherein each of said flow vents comprises a tapered portion having a first end and an opposite second end, the second end defining a cross-sectional area smaller than the cross-sectional area of said first end.

20. A loudspeaker device as defined in claim 19, wherein said tapered portion is of generally frusto-conical configuration.

21. A loudspeaker device as defined in claim 19, including a voice coil space disposed within said voice coil, said pole piece being of annular construction and including a bore formed therethrough to provide communication between said voice coil and the exterior of said assembly, an an air permeable airflow resistancee member slidably disposed within said bore.

22. A loudspeaker device as defined in claim 21, wherein said airflow resistance member is formed of flexible foam material.

23. A loudspeaker device with differential flow vent means comprising an enclosure, said enclosure being substantially closed to define an interior space, first differential flow vent means comprising a pair of differential flow vents, one of said vents providing greater resistance to airflow from ambient air into said space, and the other of said vents providing greater resistance to airflow from said space to ambient air, and an additional differential flow vent providing greater resistance to airflow from ambient air into said space, a speaker assembly supported within said space, said woofer assembly including a speaker cone having a central axis, a generally annular electrical winding supported by the speaker cone and forming a voice coil for vibrating the speaker cone, a pole piece positioned coaxially of said voice coil, a magnet structure cooperable with the pole piece for driving said speaker cone in response to electrical signals applied to the coil, said pole piece and said magnet structure defining an air chamber therebetween, a backplate for supporting the magnet structure and pole piece, and second differential flow vent means disposed within said backplate to provide communication between the air chamber and said space, said second differential flow vent means comprising a pair of elongated passages and being disposed substantially parallel to said central axis, each of said passages having a differential flow vent therein, one of said vents of said passages providing greater resistance to airflow from said space into said chamber, and the other of said vents of said passages providing greater resistance to airflow from said chamber to said space.

24. A loudspeaker device as defined in claim 23, wherein each of said flow vents comprises a tapered portion having a first end and an opposite second end, the second end defining a cross-sectional area smaller than the cross-sectional area of said first end.

25. A loudspeaker device as defined in claim 24, wherein said tapered portion is of generally frusto-conical configuration.

26. A loudspeaker device as defined in claim 24, including a voice coil space disposed within said voice coil, said pole piece being of annular construction and including a bore formed therethrough to provide communication between said voice coil space and the exterior of said assembly, an an air permeable airflow resistance member slidably disposed within said bore.

27. A loudspeaker device as defined in claim 26, wherein said airflow resistance member is formed of flexible foam material.

28. A loudspeaker device with differential flow vent means comprising an enclosure, said enclosure being substantially closed to define an interior space, first differential flow vent means comprising a pair of differential flow vents, one of said vents providing greater resistance to airflow from ambient air into said space, and the other of said vents providing greater resistance to airflow from said space to ambient air, and an additional differential flow vent providing greater resistance to airflow from said space into said ambient air, a speaker assembly supported within said space, said woofer assembly including a speaker cone having a central axis, a generally annular electrical winding supported by the speaker cone and forming a voice coil for vibrating the speaker cone, a pole piece positioned coaxially of said voice coil, a magnet structure cooperable with the pole piece for driving said speaker cone in response to electrical signals applied to the coil, said pole piece and said magnet structure defining an air chamber therebetween, a backplate for supporting the magnet structure and pole piece, and second differential flow vent means disposed within said backplate to provide communication between the air chamber and said space, said second differential flow vent means comprising a pair of elongated passages and being disposed substantially parallel to said central axis, each of said passages having a differential flow vent therein, one of said vents of said passages providing greater resistance to airflow from said space into said chamber, and the other of said vents of said passages providing greater resistance to airflow from said chamber to said space.

29. A loudspeaker device as defined in claim 28, wherein each of said flow vents comprises a tapered portion having a first end and an opposite second end, the second end defining a cross-sectional area smaller than the cross-sectional area of said first end.

30. A loudspeaker device as defined in claim 29, wherein said tapered portion is of generally frusto-conical configuration.

31. A loudspeaker device as defined in claim 29, including a voice coil space disposed within said voice coil, said pole piece being of annular construction and including a bore formed therethrough to provide communication between said voice coil and the exterior of said assembly, an an air permeable airflow resistancee member slidably disposed within said bore.

32. A loudspeaker device as defined in claim 31, wherein said airflow resistance member is formed of flexible foam material.

33. An assembly as defined in claim 12, wherein said speaker comprises a woofer.

34. A loudspeaker device as defined in claim 18, wherein said backplate has a first surface exterior to the space and a second surface opposite the first surface in communication with the interior of the space, and the passages extend through the back plate between the first and second surfaces.

35. An loudspeaker device as defined in claim 18, wherein the differential flow vent means has a diameter of about ¼ to about ⅓ inch.

36. An assembly as defined in claim 18, wherein said speaker comprises a woofer.

37. A loudspeaker device as defined in claim 23, wherein said backplate has a first surface exterior to the space and a second surface opposite the first surface in communication with the interior of the space, and the passages extend through the back plate between the first and second surfaces.

38. An assembly as defined in claim 23, wherein said speaker comprises a woofer.

39. A loudspeaker device as defined in claim 28, wherein said backplate has a first surface exterior to the space and a second surface opposite the first surface in communication with the interior of the space, and the passages extend through the back plate between the first and second surfaces.

40. An assembly as defined in claim 28, wherein said speaker comprises a woofer.

* * * * *